US005802664A

United States Patent [19]

Mondigo et al.

[11] Patent Number: 5,802,664

[45] Date of Patent: Sep. 8, 1998

[54] POWER HEAD FOR CLEANING MACHINE

[75] Inventors: Jesse V. Mondigo, Aurora; Gary Edward Palmer, Roselle; Jerome E. Rau, Hoffman Estates, all of Ill.

[73] Assignee: Minuteman International, Inc., Addison, Ill.

[21] Appl. No.: 733,365

[22] Filed: Oct. 17, 1996

[51] Int. Cl.[6] ..... A47L 7/00

[52] U.S. Cl. ..... 15/322; 15/321; 15/389; 15/391; 15/392

[58] Field of Search ..... 15/321, 322, 389, 15/391, 392

[56] References Cited

U.S. PATENT DOCUMENTS

B 1,489,337 3/1994 Girman et al. .

4,360,946 11/1982 Marshall, Jr. ..... 15/321

4,759,094 7/1988 Palmer et al. .

4,893,375 1/1990 Girman et al. .

*Primary Examiner*—Diana Biefeld

*Attorney, Agent, or Firm*—Emrich & Dithmar

[57] ABSTRACT

A motorized power head for a machine for cleaning upholstery, carpeting or hard floors includes a spray nozzle for distributing a clean spray solution on a selected area enclosed by the power head. A cylindrical rotating brush is driven by a two-speed motor housed in the power head to work the solution into the carpet to clean the selected area. A suction nozzle picks up the spent solution together with loosened dirt and grime. The power head may be used as a close-up applicator with a handle adjacent the power head, or as a stand-up applicator with an extension inserted between the handle and the power head. The brush is easily removed for replacement or for converting the apparatus for different applications.

9 Claims, 5 Drawing Sheets

Fig. 7
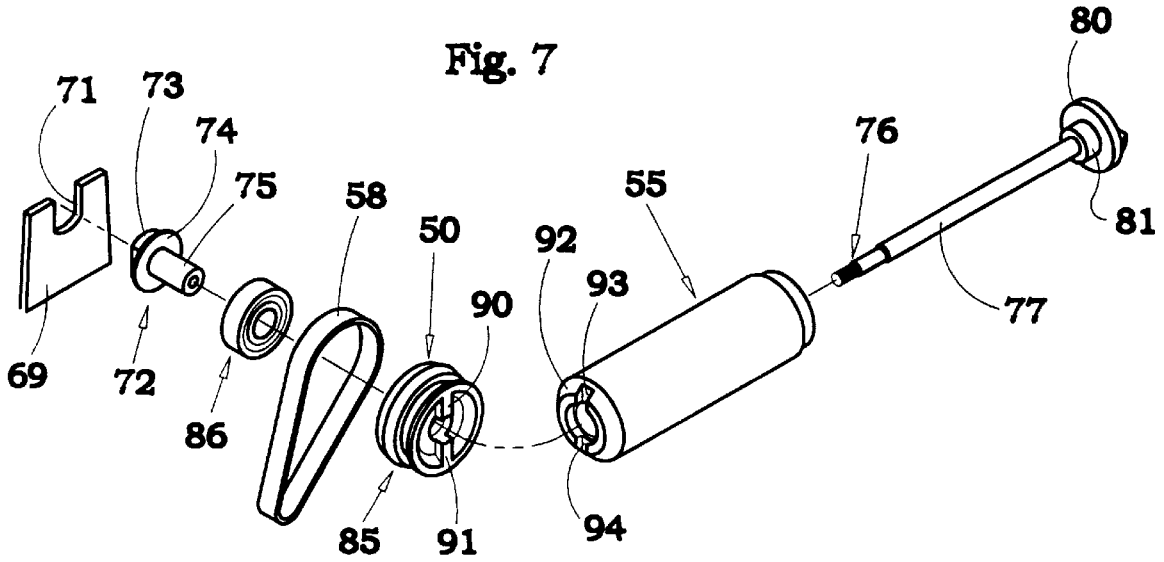
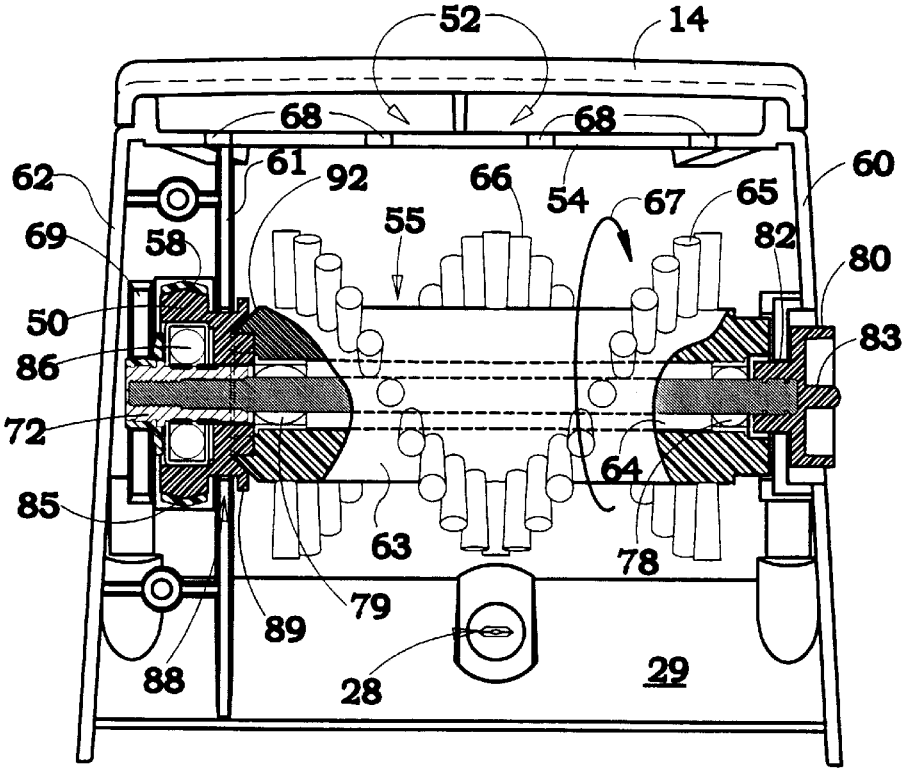
Fig. 6

POWER HEAD FOR CLEANING MACHINE

FIELD OF THE INVENTION

The present invention relates to a power head for a cleaning machine; and more particularly to a self-contained power head which may be used for cleaning carpeting, upholstery or hard floors with a motor-driven brush.

BACKGROUND AND SUMMARY OF THE INVENTION

Automatic carpet scrubbing machines are known in the industry. Typically, a large machine may include: a device for spraying cleaning liquid on the carpet; a motor-driven brush for working the cleaning solution into the carpeting to loosen the dirt, debris and grime in the carpeting; and a vacuum nozzle for recovering the spent solution and delivering it to a reservoir in the machine. One such machine is disclosed in U.S. Pat. No. 4,759,094.

Automatic carpet machines are expensive and they are not suitable for close-up or "detail" cleaning. In fact, they leave a marginal area adjacent walls and other upright obstructions which is not cleaned because the brush is mounted beneath the machine and spaced inwards of the side of the machine. Another, much less expensive style of carpet cleaning machine includes a power head with a motor-driven head mounted to a wand and connected to a remote console with a flexible suction hose. The power head, operated by a person in the standing position, includes a spray device for applying a cleaning solution to the carpet and a suction device for recovering the spent cleaning solution.

Neither automatic carpet machines nor the style having a power head with wand applicator is suitable for cleaning upholstery which is more delicate than carpeting, nor for close-up detail work.

Smaller carpet cleaning appliances, known as "carpet spotters" are also known. Carpet spotting machines typically have a console or housing containing a reservoir of cleaning solution and a second reservoir for holding the recovered, spent solution. A flexible suction tube connects the console to a remote suction head which also contains a spray nozzle. The operator actuates the spray nozzle to spray the fresh cleaning solution onto an area to be cleaned, and the operator then works the solution manually into the carpeting with a brush or the like. The operator then actuates the suction mechanism (the suction motor being located in the remote console), and the suction nozzle on the cleaning head is used to suction up the spent solution and remove dirt and debris with it.

Carpet spotters are much smaller than the automatic carpet scrubbing machines mentioned above, and they are designed to clean smaller, individual areas of a carpet. The entire carpet may not need to be cleaned, but small areas or spots of dirt may be present on the carpet. Carpet spotters are lighter in weight, and more maneuverable than the larger automatic carpet scrubbing machines.

The present invention not only incorporates an electric motor into a remote power head for a carpet spotter, but it includes a handle and trigger assembly which adapts the machine for stand-up work (for larger jobs) or for close-up work (for spot removal or cleaning upholstery). Moreover, the invention arranges the mounting for the driven, rotating brush in a manner to facilitate removal and replacement of the brush without the need for special tools or elaborate procedures such as removing the belt which drives the brush.

Thus, a brush with a soft bristle may be used in the close-up arrangement for upholstery work; and a brush with a stiff bristle may be used for close-up spotting or, with an extension inserted, for stand-up work over larger areas.

The present invention thus has application to carpeting, upholstery and all surfaces found on hard floors.

That is, the power head is designed so that it may be mounted directly to the handle and trigger assembly in cases where the operator may want to work close to the area being cleaned, or the operator may insert an extension tube between the power head and the handle and trigger assembly, thereby permitting the operator to remove spots, or otherwise clean larger areas of the carpet from a standing position.

Still further, the housing is designed so that the brush, which is cylindrical and rotates about a horizontal axis, has one end very close to one side wall of the housing of the power head. This permits the operator to use the power head to clean areas close to a wall or a molding or other vertical obstruction.

As mentioned, automatic carpet machines of the type mentioned above do not permit the operator to clean carpeting right up to a wall. Such machines typically leave a marginal area of 3–6 inches where the carpet is not cleaned. The present invention permits the operator to clean these marginal areas previously unreachable by automatic carpet machines.

Other features and advantages of the present invention will be apparent to persons skilled in the art from the following detailed description of a preferred embodiment accompanied by the accompanying drawing where identical reference numerals will refer to like parts in the various views.

BRIEF DESCRIPTION OF THE DRAWING

FIG. 6 is a view looking directly into the brush chamber along the sight line 6—6 of FIG. 5, with end portions of the brush and its mounting system in cross sectional; and FIG. 7 is a perspective view of the brush holder on the brush core and mounting system seen in FIG. 6, with the components in exploded relation and with the brush core turned to show its engagement with a keyed cradle 50.

BRIEF DESCRIPTION OF A PREFERRED EMBODIMENT

Figure 1:
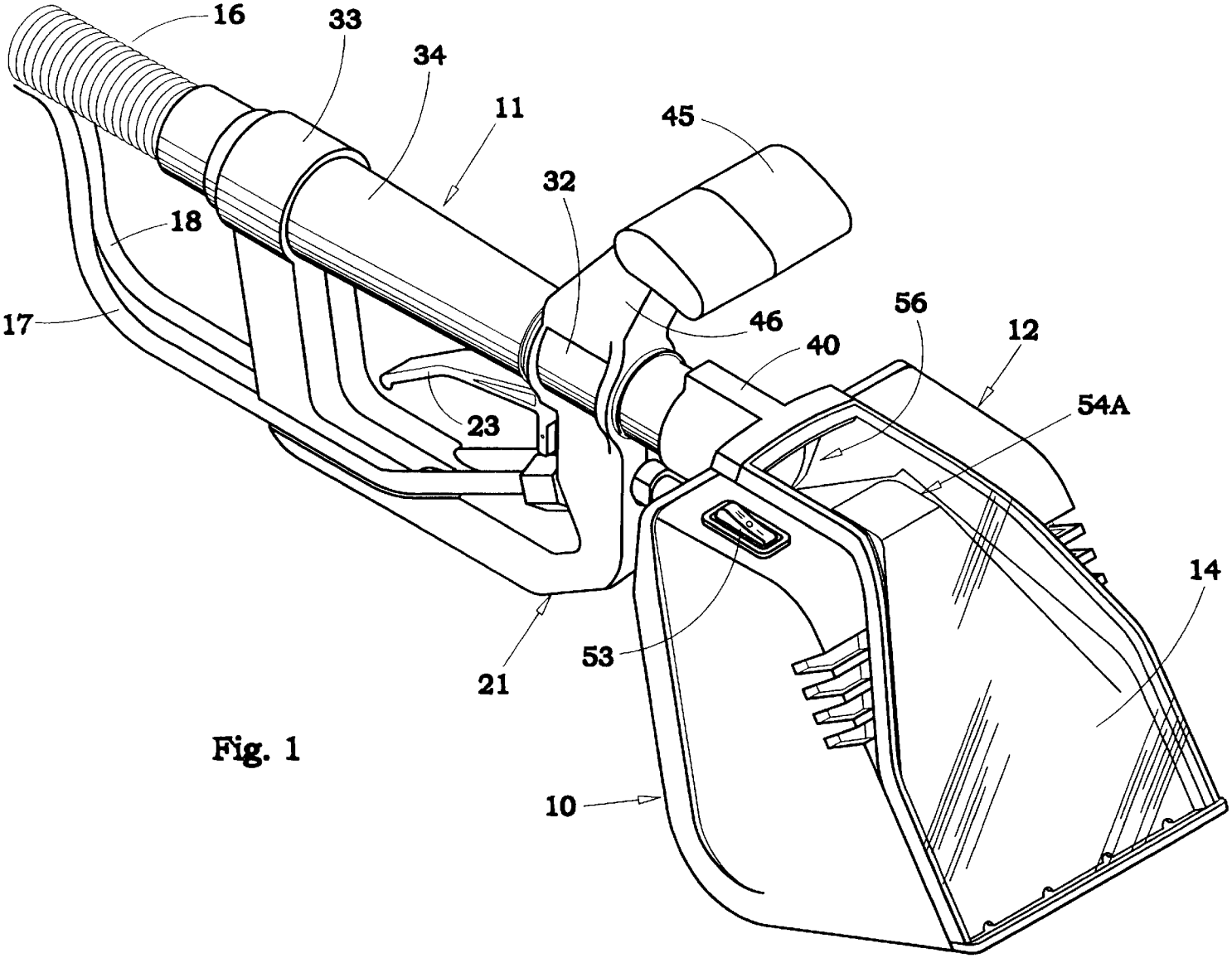
FIG. 1 is an upper, frontal perspective of a power head constructed according to the present invention and arranged for close-up work.

Referring to FIG. 1, reference numeral 10 generally designates a power head which is mounted to a handle and trigger assembly (or simply "handle") generally designated 11. The power head 10 includes a brush housing 12 to the front of which there is mounted a plate 14, made of clear plastic material, which defines a vacuum recovery chamber.

At the rear of the handle 11 there is mounted a conventional vacuum hose, seen in fragmentary form and generally designated 16, which communicates the vacuum chamber of the power head with a reservoir in a remote console (typically resting on the floor) and which is evacuated by a suction motor in a conventional manner.

Figure 4:
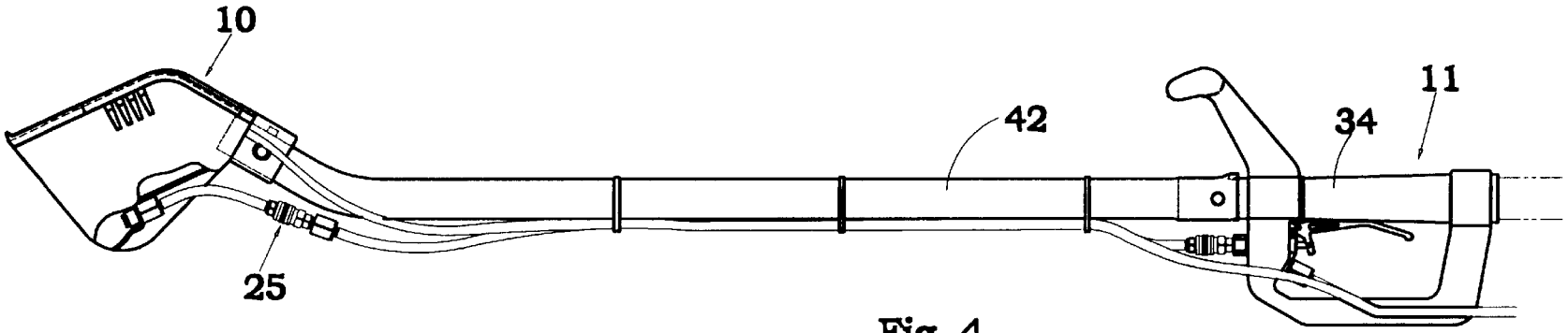
FIG. 4 is a left side elevational view of the power head, handle and extension tube for use by an operator in the standing position.

A solution feed conduit 17 and an electrical cord 18 are routed along the vacuum hose 16 and secured to it by means of plastic ties (not shown in FIG. 1 but seen in FIG. 4 for securing the cord and feed conduit to the extension tube). The solution tube 17 is fed by a pump in the remote console which forces the cleaning solution under pressure through the solution tube 17 to a valve mounted in the forward portion of a trigger guard 21 in the area designated 19 in FIG. 2. The valve is actuated by means of a plunger 20 connected to a trigger member 23, as seen in FIG. 3 (wherein the trigger 23 is shown in the actuated position).

The upper forward portion of the trigger is pivotally mounted at 24 so that when the trigger 23 is actuated by the operator, it rotates in a counterclockwise direction about the pivot 24, thereby extending the plunger 20 and opening the valve to permit the cleaning fluid to flow under pressure. The fluid flows from the tube 17, through a quick-disconnect connector generally designated 25, and a short section of conduit 26 to a spray nozzle generally designated 28 mounted to a lower wall 29 inside the brush housing 12. The rear of the housing also includes a cover 29A for the motor (see FIG. 2 in particular).

Figure 2:
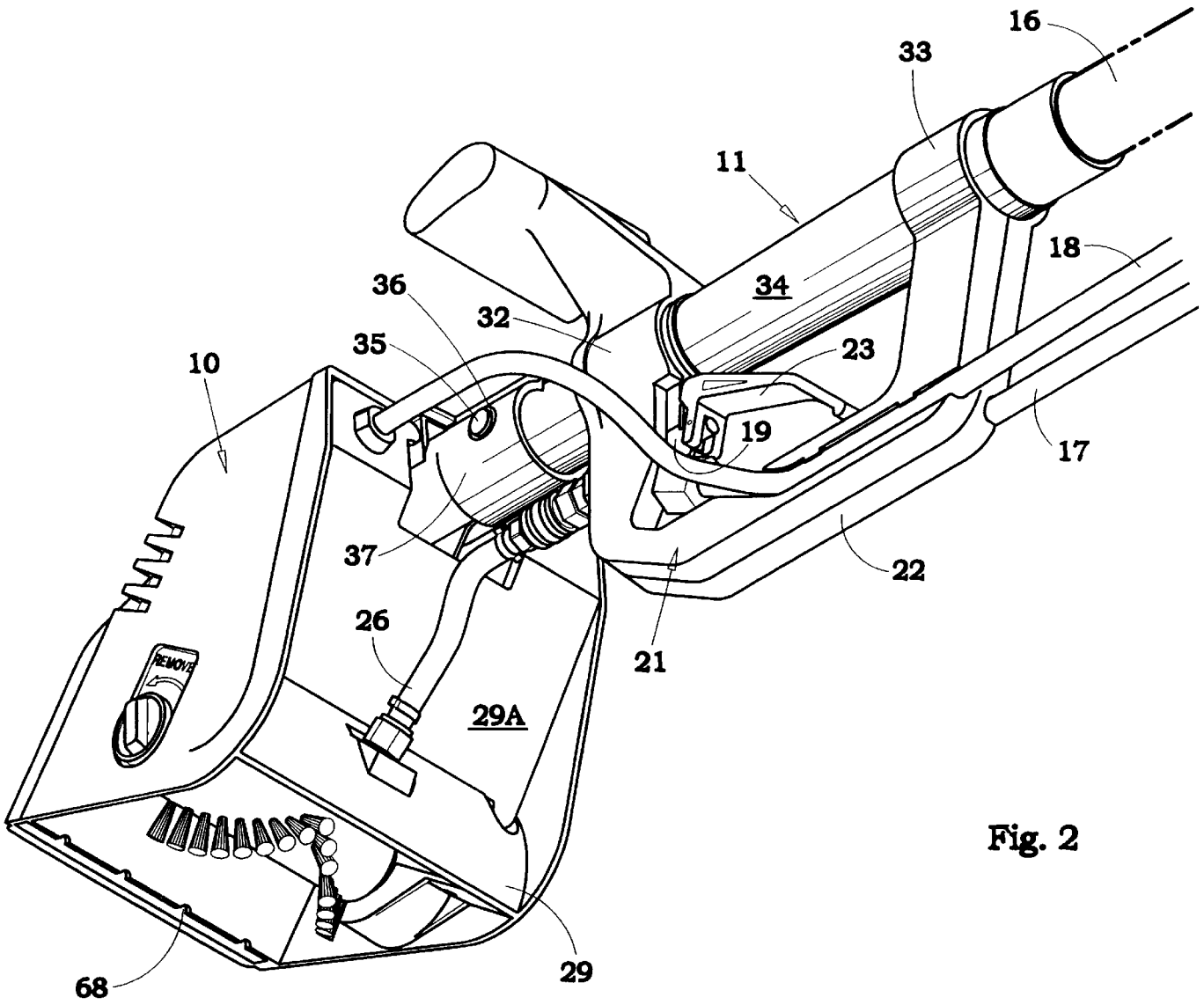
FIG. 2 is a perspective view taken from the lower, left side of the power head.
Figure 3:
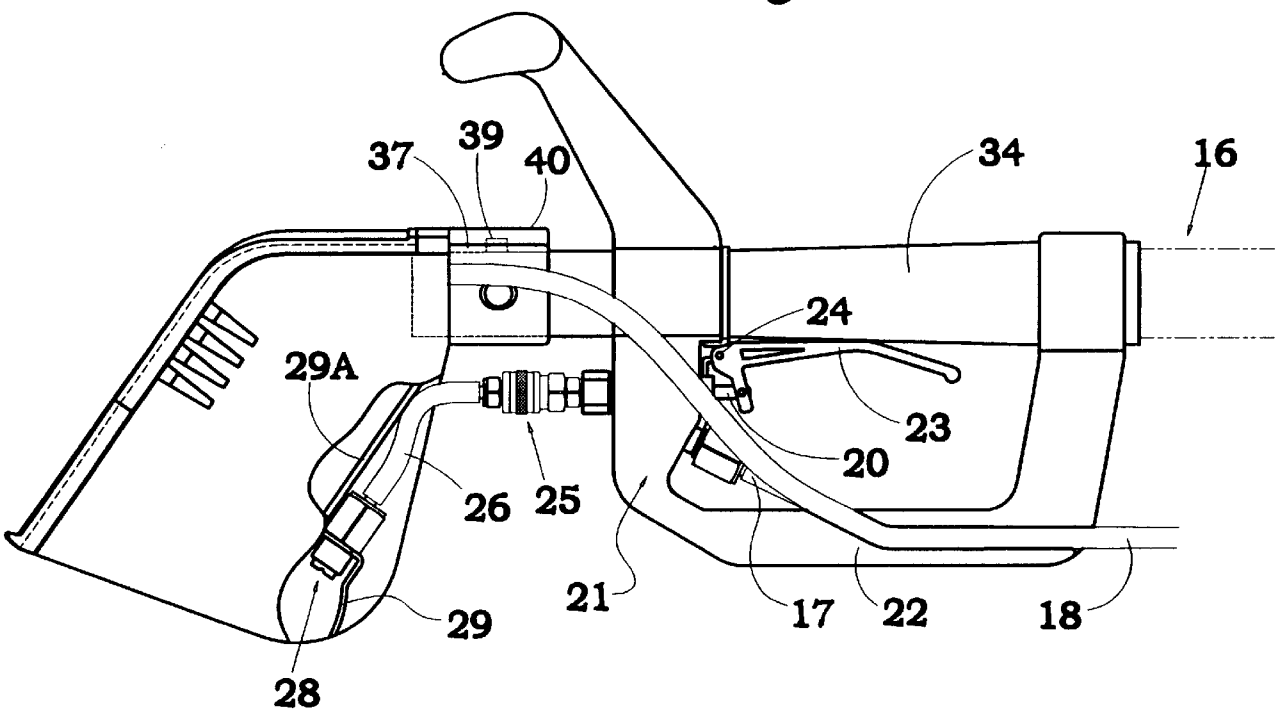
FIG. 3 is a left side elevational view of the power head of FIG. 1 with a portion of the brush housing broken away to show the spray nozzle.

As used in this application, the terms "left" and "right" are referenced to the line of sight of a user of the power head—that is looking to the left in FIGS. 3 and 4. As seen in FIGS. 2 and 3, the electrical cord 18 is routed along the lower portion 22 of the left side of trigger guard 21, preferably in a formed recess for securing and protecting it, to the cover 29A, where it is fed through the cover into a chamber for the motor, best seen in FIG. 5, and described further below. The solution tube 17 is similarly routed along the lower portion of the right side of the trigger guard, also in a recess.

Still referring to FIGS. 1–3, the upper, forward portion of the trigger guard 21 is provided with a collar 32, and the upper rear portion of the trigger guard is provided with a second collar 33. The collars 32, 33 are received on and mounted to a frame tube 34. The rear end of the frame tube 34 receives the forward end of the vacuum hose 16; and the forward end of the frame tube 34 serves to mount the power head 10 by means of a depressible locking pin 35 received in a slot 36 on a rearwardly-extending tubular adapter 37 mounted to the upper rear portion of the power head 10, as best seen in FIGS. 2 and 3. The frame tube 34, forms a continuation of the suction conduit or hose 16.

Referring to FIG. 3, the top surface of the frame tube 34, at its forward end, is provided with a pin or projection 39 which is received in a guide channel 40 (FIG. 1) formed at the top of the adapter 37 of the power head. Thus, the power head and handle assembly may be separated by disconnecting the connector 25, and depressing the lock pin 35, and sliding the frame tube 34 rearwardly. This permits an extension or intermediate suction tube section shown at 42 in FIG. 4 to be interposed between the handle assembly 11 and the power head 10. The extension 42 permits an operator to use the power head in a standing position.

Returning to FIGS. 1 and 2, a hand grip 45 formed at the upper portion of a standard 46.is formed integrally with the forward collar 32 of the trigger guard 21. This permits the operator to grasp the frame tube 34 with one hand while operating the trigger 23 with the same hand, and to grasp the grip 45 with the other hand to maneuver the power head, either in the compact configuration of FIG. 1 for close-up carpet work or for cleaning upholstery, or with the extension tube 42 as seen in FIG. 4, for stand-up work.

Figure 5:
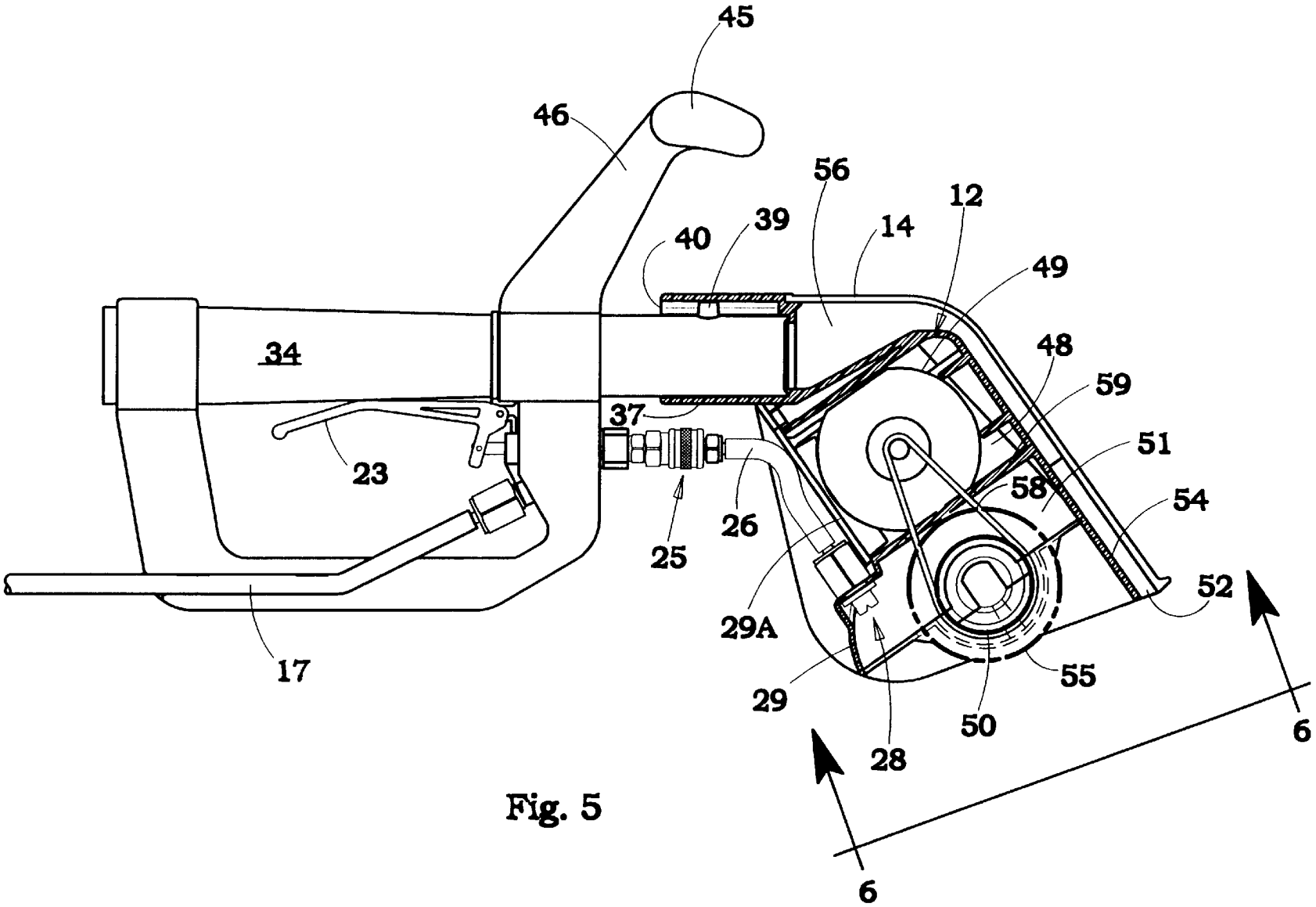
FIG. 5 is a left side view of the power head of FIG. 1 with the brush housing and vacuum recovery chamber in cross section.

Turning now to FIG. 5, the brush housing 12 includes an upper chamber 48 (partially defined by cover 29A) for mounting an electrical motor 49, energized by electrical power coupled through the cord 18 and switch 53. A lower chamber shown at 51 houses the brush. The vacuum recovery chamber formed by the plastic plate 14 and a forward wall 54 of the housing extends from a laterally elongated suction inlet opening designated 52 in FIG. 5, upwardly between the plate 14 and a forward wall 54 of the brush and motor housing. The vacuum chamber then deepens and narrows in a plenum designated 56 in FIG. 5; and the forward opening of the frame tube 34 received in the adapter 37 is in fluid communication with the plenum 56. The forward wall 54 has side channels (see 54A in FIG. 1) formed adjacent the sides of the vacuum chamber and leading to the plenum 56. Thus, the spent solution is vacuumed through the suction opening 52 upwardly into the plenum 56, and through the tube frame 34 and suction hose 16 into the recovery reservoir in the remote console. The channels 54A cause the fluid to flow directly into the plenum and not collect on the surface of the wall 54 at the base of the vacuum recovery chamber.

Further, when the suction motor is turned off, droplets are collected in the plenum which acts as a reservoir to prevent the fluid from dripping out of the power head onto the material on which the operator is working.

The brush is shown at 55 in FIG. 5, and it is driven by a belt 58 entrained around the shaft of the motor 49, and a pulley or keyed cradle designated 50. Brush 55 is rotated in a counterclockwise direction (as viewed in FIG. 5). The operation of the apparatus will now become apparent to persons skilled in the art. The operator, holding the foreshortened version of the power head and handle assembly as described above, actuates the trigger 23, thereby forcing cleaning solution under pressure through the nozzle 28 where the solution is sprayed onto the carpet. The brush rotates in a counterclockwise direction so that as the operator pulls the power head toward the rear in FIG. 5, the brush works the solution into the carpet, removing dirt and grime, and forcing the spent solution, dirt and grime forwardly, where it is recovered through the suction inlet opening 52 and delivered to the recovery reservoir in the remote console already described.

Still referring to FIG. 5, the motor chamber 48 and the brush chamber 51 are separated by an intermediate horizontal wall 59 which extends between a left side wall 60 and an intermediate upright wall 61 which is spaced inwardly of, and supported against, a right side wall 62 (see FIG. 6).

Referring then to FIG. 6, the brush 55 includes a core 63 having a center bore 64. First and second sets of bristles 65, 66 are mounted to the core 63 in a pattern whereby each group of bristles is located closer to the mid-point of the core as one proceeds inwardly and clockwise about the core, as viewed from the left side (which is the right side of FIG. 6). Thus, as the brush rotates, the outermost bristles force recovered material and spent solution forwardly toward the inlet opening 52 of the vacuum chamber, and then successive groups of bristles spaced inwardly are rotated into contact with the carpet, forcing forwardly the material desired to be recovered and removed. The lower portion of the forward wall 52 of the brush housing and chamber is provided with a series of spaced notches 68. Air passes through the notches 68 to entrain the material being removed by suction. The brush 55 rotates in a clockwise direction viewed from the left side of the machine, and is illustrated by the arrow 67 in FIG. 6.

Referring now to FIGS. 6 and 7, a support wall 69 is notched at 71 to receive and support the capped end of a threaded member 72. The cap 73 of member 72 has opposing, flat sides received in the notch 71 so that it cannot rotate. The member 72 also includes a flange 74 and an internally threaded extension 75 which receives the threaded end 76 of a shaft 77. The shaft 77 is received in the center bore 64 of the brush core 55, and supports the brush core by means of first and second bearings 78, 79. The left end of the shaft 77 (the right end as seen in FIG. 7) is provided with a plastic knob 80 which includes a cylindrical receptacle 81 fixed to the end of the shaft and received in an opening in a recessed wall portion 82 of the side wall 60. The knob 80 also includes an elongated member 83 which permits the operator to grasp the knob to remove the shaft 77 from the bushing 72. Since the brush rotates counterclockwise when viewed from the right side of FIG. 6, the thread of extension 76 has a left-handed thread, requiring that the shaft be rotated counterclockwise.

Turning now to the left side of FIG. 6, the keyed cradle 50 includes a pulley 85 having a chevron-shape in cross section to form a crown. The belt 58 is entrained about the pulley 85, and the crown shape maintains the belt in driving engagement with the pulley. The cradle 50 is rotatably mounted on the extension 75 of the bushing 72 by means of a bearing 86.

The right side of the cradle 50 (as viewed in FIG. 7) includes a recess at 88 permitting the pulley to be mounted in a slot in the intermediate wall 61, and the cradle is flanged at 89 to maintain its mounting to the intermediate wall. The side of the cradle 50 which receives the brush core is recessed in the center, and includes a pair of inwardly extending keys, 90, 91, arranged in a line and straddling the central bore of the brush core, as seen in FIG. 7. The recessed end of the cradle 85 receives a correspondingly cambered end 92 of the brush core 55. The cambered end 92 of the brush core includes a pair of aligned slots 93, 94 which receive the keys 90, 91 of the cradle 85. This permits the cradle 85 to maintain driving engagement with the brush core 55 when the components, shown in FIG. 7, are assembled as seen in FIG. 6.

To replace the brush, the operator unscrews the knob 80, and removes the shaft 77 from the brush housing by sliding the shaft outwardly to the right in FIG. 6. The left side of the brush core (that is the right side in FIG. 6) may then be moved downwardly, permitting the drive side of the brush core to be removed from the recess of the cradle 85. This is due to the frusto-conical shape of the recess in the right side of the cradle as viewed in FIG. 6, and the corresponding frustoconical shape of the cambered end 92 of the brush core. Thus, without any special tools or procedures, the operator can change from a soft bristle to a harder bristle brush depending upon the need, or he may change brushes if one if worn out, in a convenient and time efficient manner.

In summary, the power head may be mounted directly to the handle, as seen in FIGS. 1 and 2 for close-up work on a carpet, or for cleaning upholstery. By adding an extension tube between the power head and the handle (and lengthening the solution feed tube and electrical power cord, of course), the operator may work at a distance or standing up.

Preferably the motor 49 is a two-speed motor and the switch 53 has a "slow" and a "fast" speed. This permits the operator to use the high speed with a stiff bristle brush for cleaning carpets or heavier material or hard floors, and to use the slow speed and a softer brush for more delicate materials.

Having thus disclosed in detail a preferred embodiment of the invention, a person skilled in the art will be able to modify certain of the structure which has been illustrated and to substitute equivalent components or structure for those disclosed while continuing to practice with the principle of the invention; it is, therefore, intended that all such modifications and substitutions be covered as they embrace within the spirit and scope of the appended claims.

I claim:

1. An apparatus for cleaning material comprising, in combination:

a power head including a housing; a brush rotatably mounted in said housing and adapted to be applied to the material to be cleaned; a motor mounted within said housing for driving said brush; a nozzle in said housing for spraying a cleaning solution under pressure on said material under control of an operator; and means defining a vacuum chamber having an inlet opening adjacent the region of said brush applied to said material and a discharge opening for passing fluid recovered through said inlet; and a handle adjacent said power head including a suction tube having a first end in fluid communication with said discharge opening of said power head; conduit means for including an actuator for feeding a cleaning solution from a source to said nozzle; and a hand grip mounted to said suction tube; whereby said handle and power head are in close physical proximity for close up work on said material.

2. The apparatus of claim 1 further comprising means for releasably connecting said first end of said suction tube of said handle with said housing of said power head, and further including an elongated extension conduit having a first end and a second end, said first end of said extension conduit adapted to be mounted to said power head when said handle is disconnected therefrom, and said second end of said extension tube being adapted to be mounted to said first end of said suction tube of said handle;

whereby said tool may be used in a stand up position with said handle and grip operated by an operator in a standing position, and said power head adjacent carpeting on the floor.

3. The apparatus of claim 2 wherein said housing of said power head includes a generally cylindrical adapter for receiving said first end of said suction tube of said handle, said adapter further including a guide slot for receiving an associated pin adjacent said first end of said suction tube, said adapter further including a slot for receiving a compressible projection adjacent said first end of said suction tube for releasably locking said handle to said housing.

4. The apparatus of claim 1 wherein said power head includes first and second side walls spaced laterally to define a chamber for mounting said brush, and further including means for mounting said brush for rotation about a transverse horizontal axis, said mounting means characterized in that one end of said brush is mounted in close proximity to one of said side walls of said housing, thereby to permit an operator to clean carpeting or upholstery adjacent vertical obstructions while leaving a marginal area of reduced width adjacent such obstructions.

5. The apparatus of claim 4 wherein said mounting means for mounting said brush in said housing of said power head includes an elongated shaft having threads at one end and a knob at the other end, said apparatus further including an internally threaded member mounted within said housing of said power head for receiving the threaded end of said shaft adjacent said second side wall of said housing, said knob of said shaft being supported, immediately adjacent said first wall of said housing, when said shaft is assembled to mount said brush in said housing.

6. The apparatus of claim 5 further comprising a pulley driven by said motor and assembled to said internally threaded member, means for rotatably mounting said pulley relative to said internally threaded member, said pulley having a first side facing said brush when said brush is assembled thereto, and a second side adjacent said second side wall of said housing, said first side of said pulley member defining a recess and having at least one drive member, said recess of said pulley adapted to receive a correspondingly shaped adjacent end of the brush, the correspondingly-shaped end of said brush having a slot for receiving said drive member of said pulley, whereby when said brush is assembled within said head, said pulley and said brush are drivingly engaged, and when said shaft is removed from said brush, the end of said brush adjacent said first side wall of said housing may be moved downwardly to disengage said second end of said brush from said pulley, whereby said brush may be replaced.

7. The apparatus of claim 1 wherein said handle further comprises a trigger guard having a forward and a rear collar mounted to said suction tube; a trigger mounted to said trigger guard; a valve mounted to said trigger guard and actuatable by said trigger for admitting fluid under pressure to said nozzle; and wherein said hand grip is mounted above said suction tube of said handle, whereby an operator may grasp said suction tube in one hand and actuate said trigger with the same hand, while grasping said hand grip in the other for maneuverability of said power head.

8. The apparatus of claim 1 wherein said vacuum chamber defines a laterally elongated slot forming said inlet opening and said discharge opening for passing fluid and dirt removed from the material being worked on; the rear wall of said vacuum chamber being formed by said housing of said power head and defining first and second channels adjacent the side thereof, said vacuum chamber characterized in being of decreasing width proceeding away from said inlet opening in the direction of movement of materials recovered thereby, and characterized in that recovered materials are routed through said channels to said discharge opening of said vacuum chamber; said vacuum chamber further defining a recessed plenum adjacent the discharge opening thereof, said discharge opening communicating with said first end of said suction tube received in said apparatus, said plenum being recessed below the upper edge of said rear wall of said vacuum chamber to collect fluid from said suction tube of said handle and prevent the same from flowing in a reverse direction in said vacuum chamber when said motor is turned off.

9. The apparatus of claim 1 further comprising a multiple-position electrical switch connected in circuit with said motor, said switch having an off position, a first position for running said motor at a fast speed, and a second position for running said motor at a low speed, whereby said apparatus is adapted for use with a soft bristle brush when operating in said low speed for cleaning more delicate materials, and said power head is adapted for use in combination with a stronger bristle brush at a high speed for jobs requiring heavier cleaning.

* * * * *